US007243388B2

(12) United States Patent
Lin

(10) Patent No.: US 7,243,388 B2
(45) Date of Patent: Jul. 17, 2007

(54) MUPTI-FUNCTION WRENCH

(76) Inventor: Yi-Ting Lin, 3F-5, No. 22, Lane 146, Der-Fu Road, South Areas, Taichung City (TW)

( * ) Notice: Subject to any disclaimer, the term of this patent is extended or adjusted under 35 U.S.C. 154(b) by 0 days.

(21) Appl. No.: 10/960,777

(22) Filed: Oct. 7, 2004

(65) Prior Publication Data

US 2006/0075571 A1 Apr. 13, 2006

(51) Int. Cl.
*B25B 13/00* (2006.01)
*B25B 17/00* (2006.01)
*B25F 1/00* (2006.01)

(52) U.S. Cl. ..... 7/138; 81/57.5; 81/60; 81/69; 81/62; 81/63; 81/63.1; 81/63.2

(58) Field of Classification Search ..... 7/138; 81/57.5, 60, 61, 62, 63, 63.1, 63.2
See application file for complete search history.

(56) References Cited

U.S. PATENT DOCUMENTS 2,726,563 A * 12/1955 Blackburn ..... 81/58.1
4,546,676 A * 10/1985 Kiefer, Jr. ..... 81/58.1
5,685,206 A * 11/1997 Ma ..... 81/77
6,474,200 B2 * 11/2002 Lai Lee ..... 81/58.1

* cited by examiner

*Primary Examiner*—Joseph J. Hail, III
*Assistant Examiner*—Shantese L. McDonald
(74) *Attorney, Agent, or Firm*—Charles E. Baxley

(57) ABSTRACT

A wrench includes a core plate made of metal and an outer portion such as rubber encloses the core plate. A driving member and a ratchet mechanism are received in the through holes in the core plate and the outer portion. A hammer piece is connected to a side of the outer portion and a chamber for receiving a bit connector and a plurality of notches for receiving bits are defined in an outer periphery of the outer portion.

6 Claims, 4 Drawing Sheets

MUPTI-FUNCTION WRENCH

FIELD OF THE INVENTION

The present invention relates to a wrench with low manufacturing cost and includes various different functions.

BACKGROUND OF THE INVENTION

A conventional wrench generally includes a head connected with a handle and a driving member is rotatably received in a through hole defined through the head. A recess is defined in an inner periphery of the through hole so as to receive a ratchet mechanism therein which includes a pawl controlled by a selector so as to engage with the driving member. The conventional wrench includes only limited number of function. Furthermore, the conventional wrench is made of metal boards which are heavy and several different machining steps, such as forging, heat treatment, polishing, and boring have to be taken to form the existed appearance of the conventional wrench. Each machining step requires a specific machine to complete, so that the assembling procedures can be time-consuming.

The present invention intends to provide a wrench that is easily to make and includes different functions.

SUMMARY OF THE INVENTION

The present invention relates to a wrench which comprises a core plate enclosed by an outer portion. The core plate has a first through hole defined in a first end thereof and a first hole defined beside the through hole. The outer portion has a second through hole which co-axially communicates the first through hole such that a driving member and a ratchet mechanism are rotatable received in the aligned first and second through holes. A second hole is defined through the outer portion and co-axially communicates with the first hole. The aligned first and second holes are polygonal holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
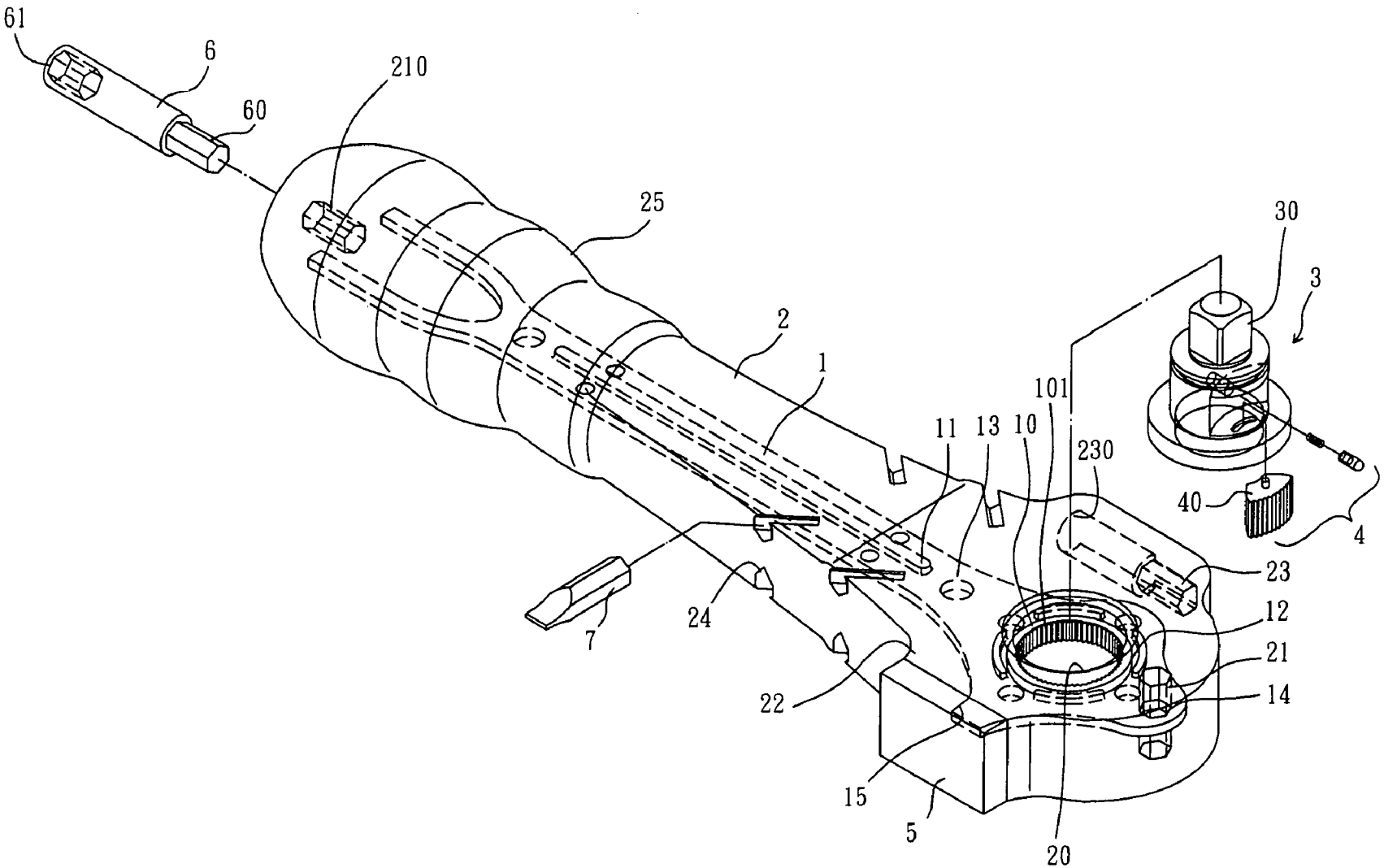
FIG. 1 is an exploded view to show the wrench of the present invention.
Figure 2:
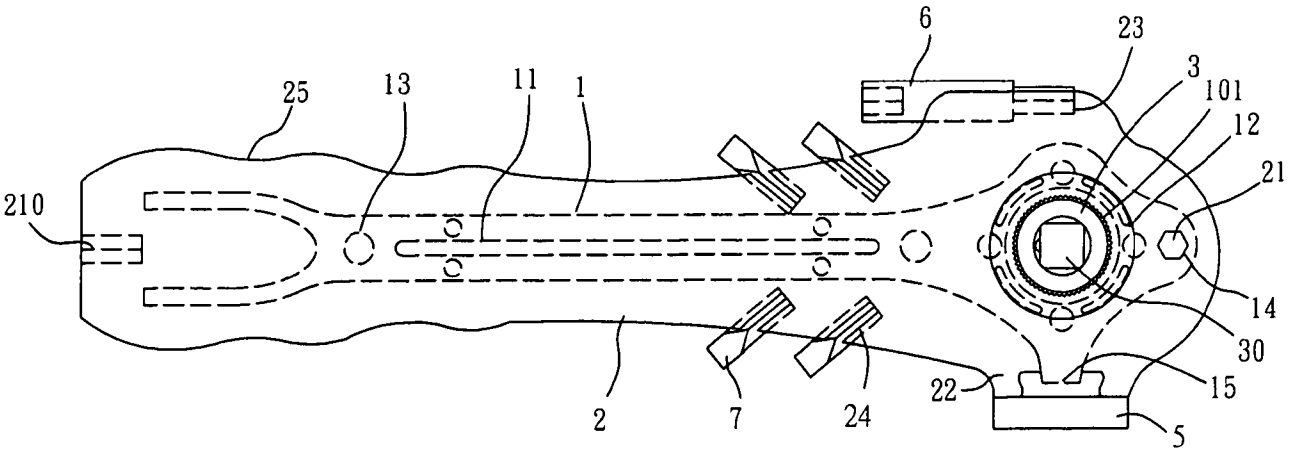
FIG. 2 is a plane view to show the bits and the bit connector are engaged with the notches and the chamber in the outer portion of the wrench of the present invention.

Referring to FIGS. 1 and 2, the wrench of the present invention comprises a core plate 1 which is made by metal plate and can be easily made by punching or any known method, the core pate 1 has a first through hole 10 defined in a first end thereof and a first hole 14 defined beside the through hole 10. A plurality of connection holes 13 are defined through the core plate 1. A neck portion 12 extends from the core plate 2 and encloses the first through hole 10. The neck portion 12 has a threaded inner periphery 101.

An outer portion 2 made of material such as rubber which is softer than the core plate 1 and encloses the core plate 1 by way of injection molding such that the material of the outer portion 2 is filled in the connection holes 13. The outer portion 2 has a second through hole 20 which co-axially communicates the first through hole 10, and a second hole 21 which is defined through the outer portion 2 and co-axially communicating with the first hole 14. An engaging hole 210 is defined in a distal end of the handle 25 of the outer portion 2. It is noted that the first hole 12, the second hole 21 and the engaging hole 210 are polygonal holes.

A driving member 3 and a ratchet mechanism 4 are received in the first through hole 10 and the second through hole 20. The ratchet mechanism 4 has a pawl 40 which is engaged with the threaded inner periphery 101 of the neck portion 12 such that the directions of the driving member 3 can be controlled to output torque.

The core plate 1 has a protrusion 15 extends threrefrom and a hammer piece 5 is embedded in the outer portion 2 and connected to the protrusion 15. The outer portion 2 includes a chamber 23 defined therein and forming an opening 230 through which a bit connector 6 is inserted in the chamber 23. A plurality of notches 24 are defined in an outer periphery of the outer portion 2 so as to receive bits 7 therein.

Figure 3:
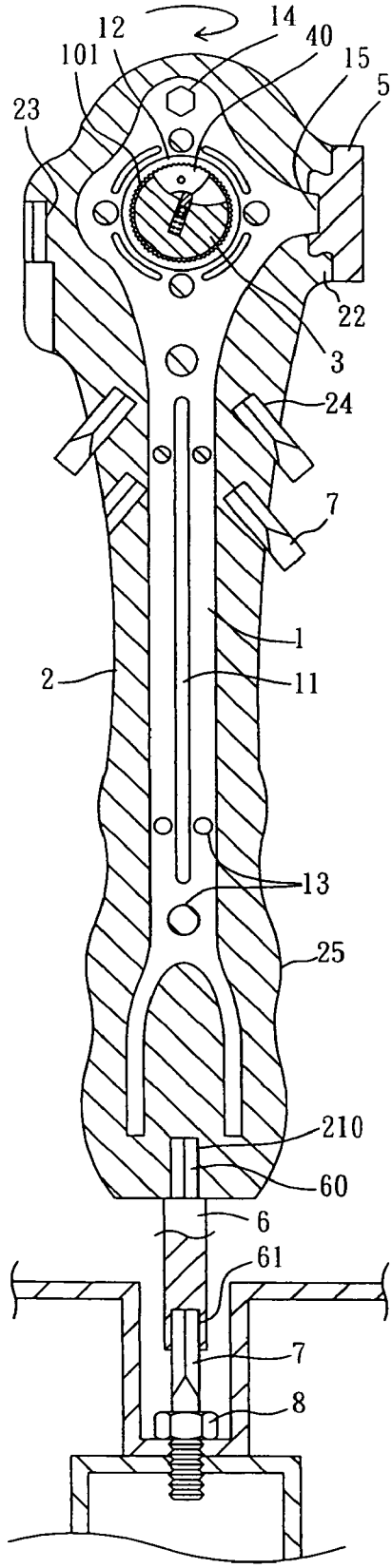
FIG. 3 shows the bit connector is connected to a distal end of the handle of the wrench and used with a bit to rotate a screw.
Figure 5:
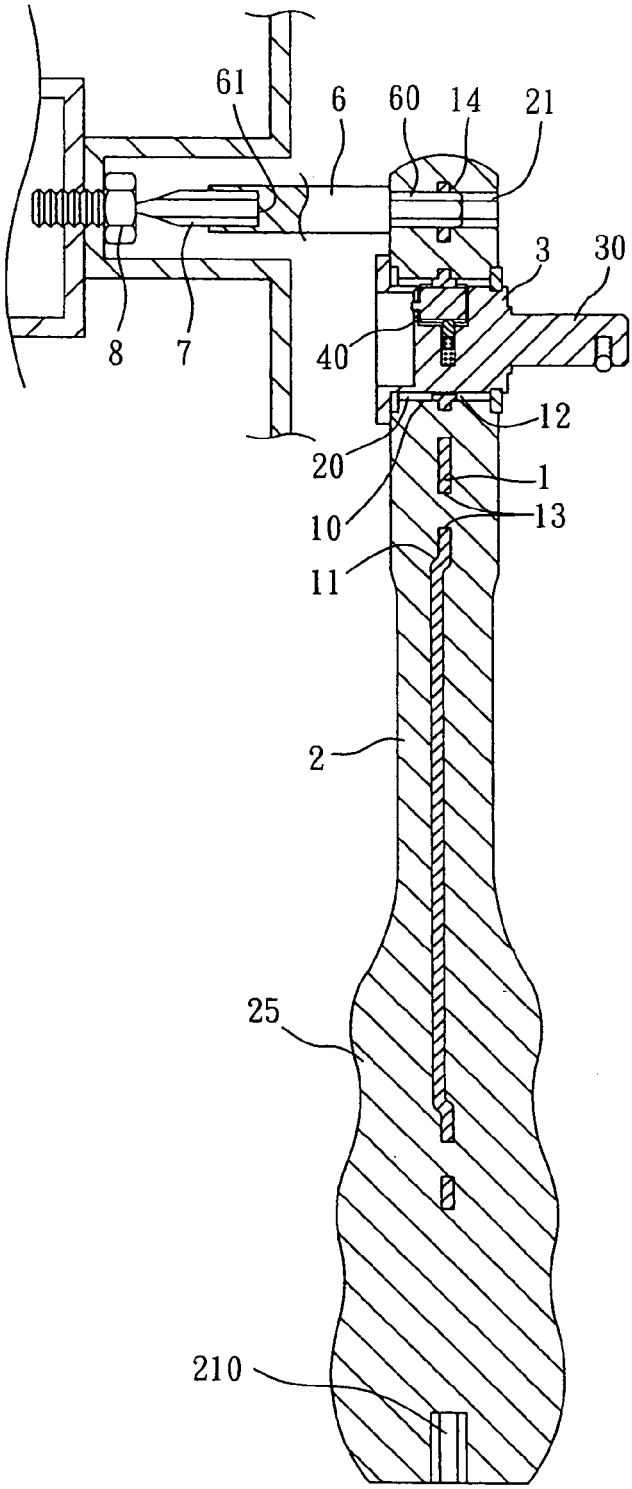
FIG. 5 shows the bit connector is connected to a front end of the wrench and used with a bit to rotate a screw.

As shown in FIG. 3, the bit connector 6 can be pulled out from the chamber 23 and a polygonal section 60 of the bit connector 6 is inserted in the engaging hole 210 in the distal end of the handle 25, and a bit 7 is connected to the bit connector 6 so as to rotate a screw 8 as shown. FIG. 5 shows that the bit connector 6 can also be inserted in the aligned first and second holes 14, and cooperates with a bit 7 to rotate a screw 8 as shown.

Figure 4:
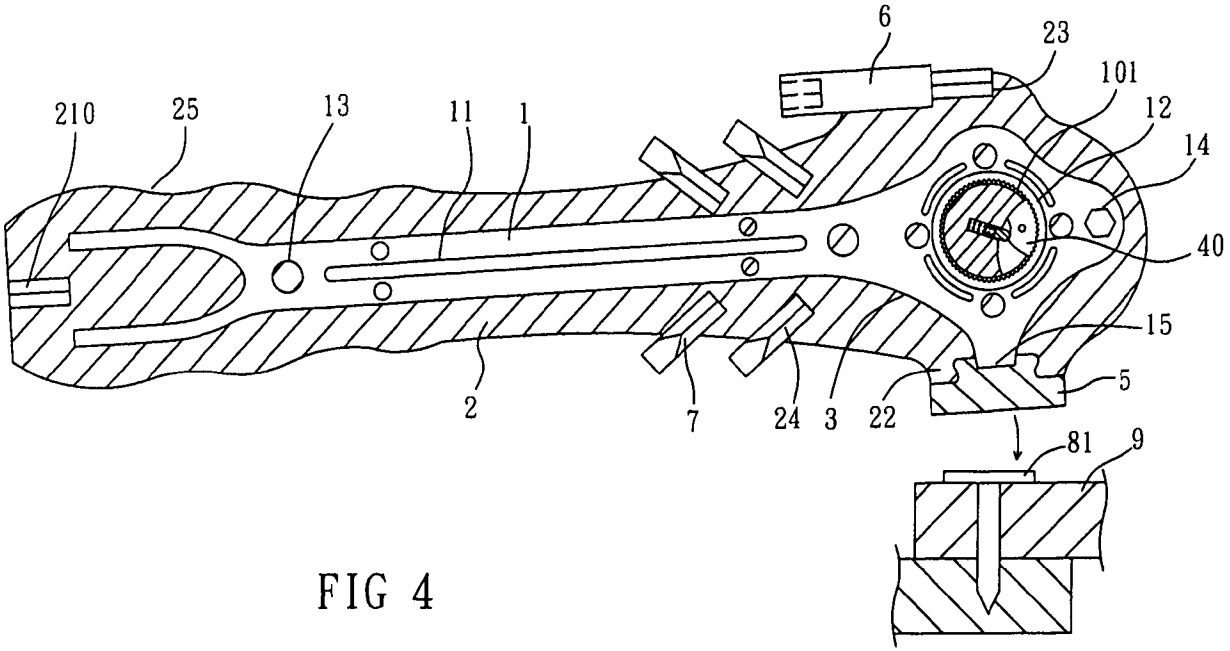
FIG. 4 shows the hammer piece is used to hammer a nail.
Figure 6:
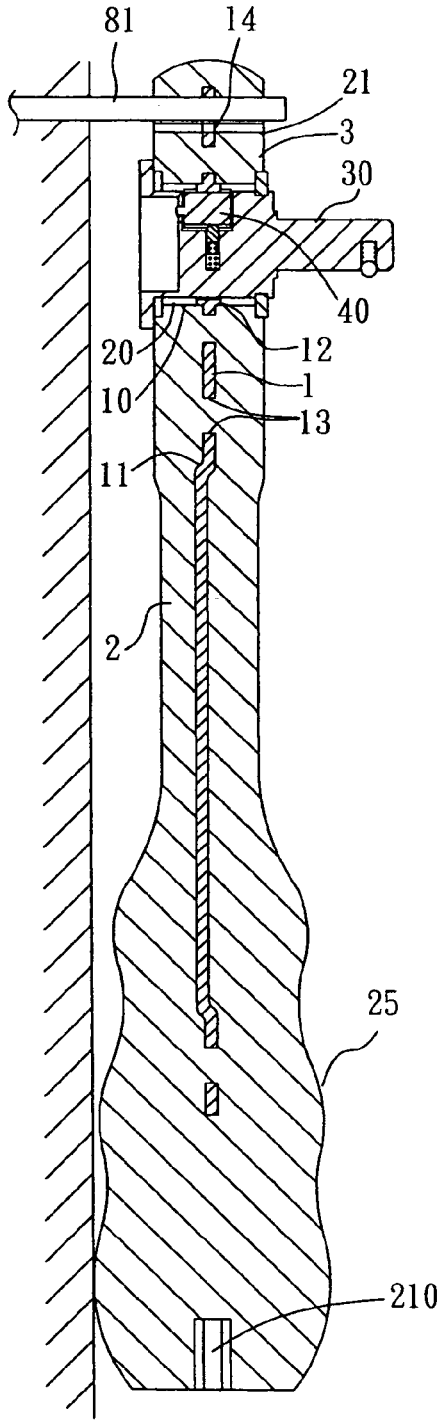
FIG. 6 shows the wrench can be hanged on a nail which extends through the aligned first and second holes.

FIG. 4 shows that the hammer piece 5 is used as a hammer to hammer a nail 81 in an object 9. The hammer piece 5 is supported by the protrusion 15 so as to bear impact. FIG. 6 shows that the wrench can be hanged on a nail 81 on a wall by extending the nail 81 through the aligned first and second holes 14, 21.

Figure 7:
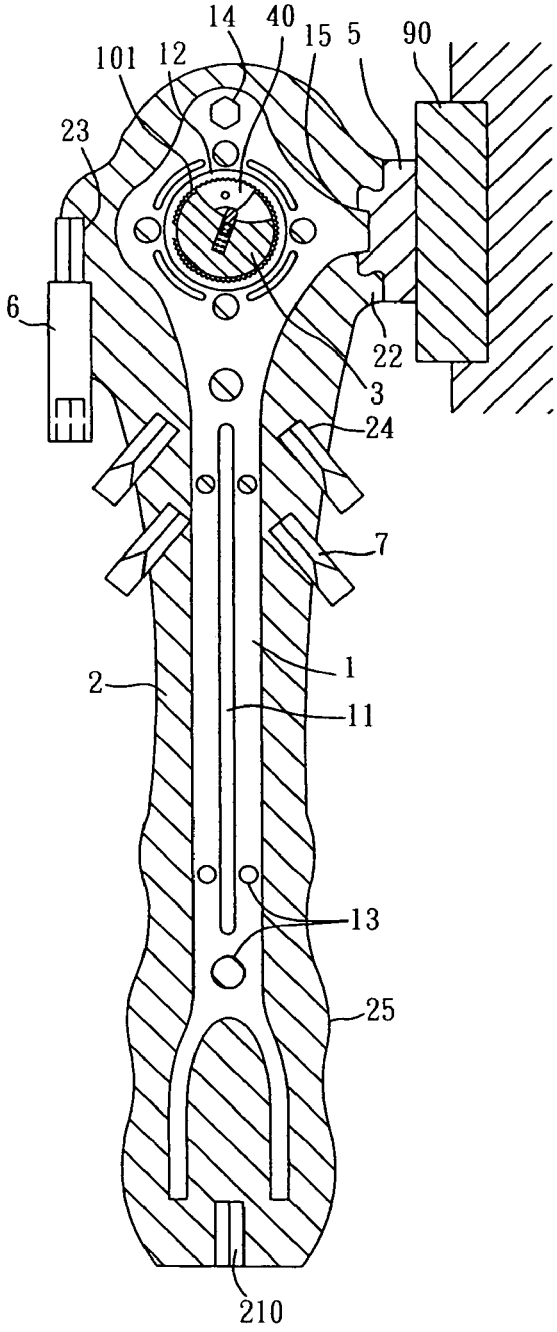
FIG. 7 shows that the hammer piece is replaced with a magnet.

FIG. 7 shows that the hammer piece 5 is replaced with a magnet which can be convenient attracted on a metal object 90 on a wall.

The wrench is light in weight and can be made much more easily than the existed wrenches in the market. The wrench also includes multiple functions and the softer outer portion 2 provide comfortable grasp when holding the wrench.

While we have shown and described the embodiment in accordance with the present invention, it should be clear to those skilled in the art that further embodiments may be made without departing from the scope of the present invention.

What is claimed is:

1. A wrench comprising:

a core plate having a first through hole defined in a first end thereof and a first hole defined beside the through hole, a plurality of connection holes defined through the core plate;

an outer portion enclosing the core plate and having a second through hole which co-axially communicates the first through hole, a second hole defined through the outer portion and co-axially communicating with the first hole, material of the outer portion is filled in the connection holes, and a driving member and a ratchet mechanism received in the first through hole and the second through hole.

2. The wrench as claimed in claim 1, wherein the aligned first and second holes are polygonal holes.

3. The wrench as claimed in claim 1, wherein the core plate is stiffer than the outer portion.

4. The wrench as claimed in claim 1, wherein the core plate has a protrusion extending threrefrom and a hammer piece is embedded in the outer portion and connected to the protrusion.

5. The wrench as claimed in claim 1, wherein the outer portion includes a chamber defined therein and forming an opening through which a bit connector is inserted in the chamber.

6. The wrench as claimed in claim 1, wherein a plurality of notches are defined in an outer periphery of the outer portion so as to receive bits therein.

* * * * *